United States Patent [19]

Schultz

[11] Patent Number: 5,033,680

[45] Date of Patent: Jul. 23, 1991

[54] OUTLET NOZZLE FOR CENTRIFUGE DRUMS

[75] Inventor: Dieter Schultz, Oelde, Fed. Rep. of Germany

[73] Assignee: Westfalia Separator AG, Oelde, Fed. Rep. of Germany

[21] Appl. No.: 548,039

[22] Filed: Jul. 5, 1990

[30] Foreign Application Priority Data

Jul. 10, 1989 [DE] Fed. Rep. of Germany ..... 3922619

[51] Int. Cl.[5] ..... B05B 3/02; B04B 7/00

[52] U.S. Cl. ..... 239/589; 239/223

[58] Field of Search ..... 239/589, 548, 565, 590, 239/223, 225.1; 494/27

[56] References Cited

U.S. PATENT DOCUMENTS 2,695,748 11/1954 Millard ..... 494/38

2,719,003 9/1955 Strezynski ..... 239/589

3,658,257 4/1972 Rood ..... 239/589

*Primary Examiner*—Andres Kashnikow

*Assistant Examiner*—Karen B. Merritt

*Attorney, Agent, or Firm*—Sprung Horn Kramer & Woods

[57] ABSTRACT

An outlet nozzle for centrifuge drums, consisting of a nozzle holder with an axial intake channel and with an orifice that is made of a harder material, that fits into the channel, and that has an axial outlet channel comprising a cylindrical bore downstream of an entry cone. The orifice is positioned in the nozzle holder such that the axis of symmetry of the intake channel is at an angle to that of the outlet channel, diverting the flow of the fluid through the nozzle. The initial section of the entry cone is provided with a semicircular recess on the same axis of symmetry, having the same radius as the intake channel, and immediately adjacent thereto.

5 Claims, 2 Drawing Sheets

OUTLET NOZZLE FOR CENTRIFUGE DRUMS

BACKGROUND OF THE INVENTION

The invention concerns an outlet nozzle for centrifuge drums, consisting of a nozzle holder with an axial intake channel and with an orifice that is made of a harder material, that fits into the channel, and that has an axial outlet channel comprising a cylindrical bore downstream of an entry cone, whereby the orifice is positioned in the nozzle holder such that the axis of symmetry of the intake channel is at an angle to that of the outlet channel, diverting the flow of the fluid through the nozzle.

A nozzle of this type is known from U.S. Pat. No. 2 695 748. It is appropriate for both radial installation at the circumference of the drum and axial installation at its top or bottom. Some of the energy consumed can be recovered in such a system by orienting the outlet channel at an angle to the intake channel. The outlet nozzle is inserted into the drum such that the fluid leaving outlet channel will leave the nozzle in a direction opposite the direction that the drum is rotating in.

The entry cone in the orifice of the known outlet nozzles is designed to ensure that the inner surface facing the intake channel and with the cone extending from it will force the fluid flowing through the intake channel to change direction before it can arrive in the cone.

That damage, especially due to cavitation and erosion, can frequently occur to the nozzle holder in outlet nozzles of this genus is known. Such damage can lead not only to rapid failure of the nozzle but also, if it is replaced too late, to damage to the centrifuge drum itself.

Extensive investigations have demonstrated that the aforesaid phenomena of cavitation and erosion originate at the interface between the rear of the orifice and the surface of the intake channel, specifically in the section of the intake channel near the outlet channel.

SUMMARY OF THE INVENTION

The object of the present invention is to improve the outlet nozzle by considerably prolonging its life.

This object is attained in accordance with the invention by providing the initial section of the entry cone with a semicircular recess on the same axis of symmetry, having the same radius as the intake channel, and immediately adjacent thereto.

It has been demonstrated that a nozzle constructed in this way will tend to lose much less material from wear in the aforesaid area. This loss of material from the known nozzles is probably due to the diversion of flow at the rear of the orifice before the fluid can enter the entry cone. The contour of the intake channel in the critical area extends in accordance with the invention, however, into the orifice, where the diversion occurs for the first time.

Advantageous embodiments of the invention are disclosed hereinafter.

Embodiments of the invention will now be described by way of example with reference to the drawings, wherein

DETAILED DESCRIPTION OF THE INVENTION

Figure 1:
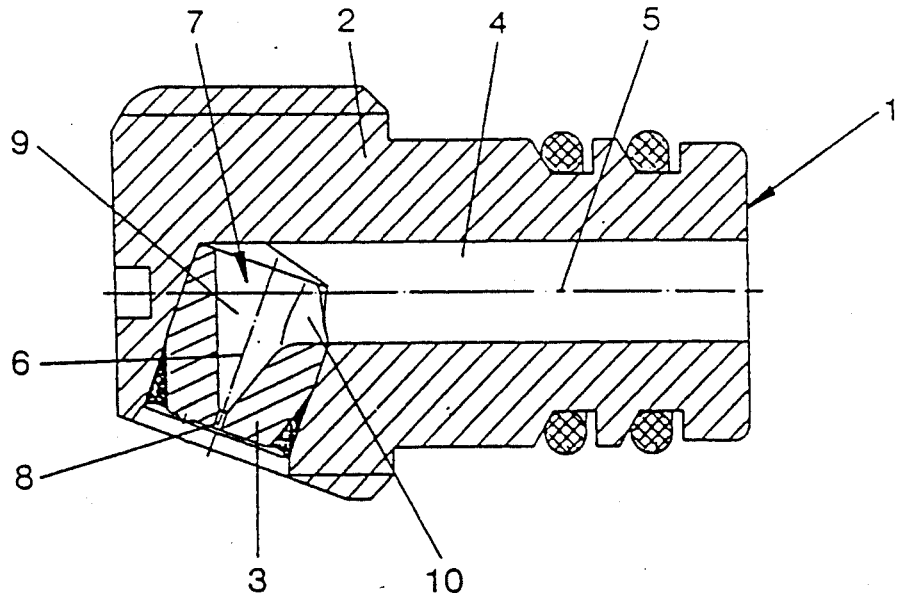
FIG. 1 is a section through an outlet nozzle according to the present invention.
Figure 2:
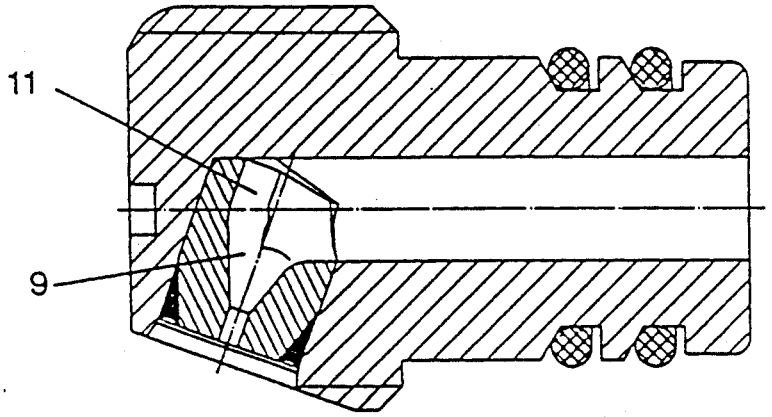
FIG. 2 is a section through an outlet nozzle with a cylindrical intake vicinity.
Figure 3:
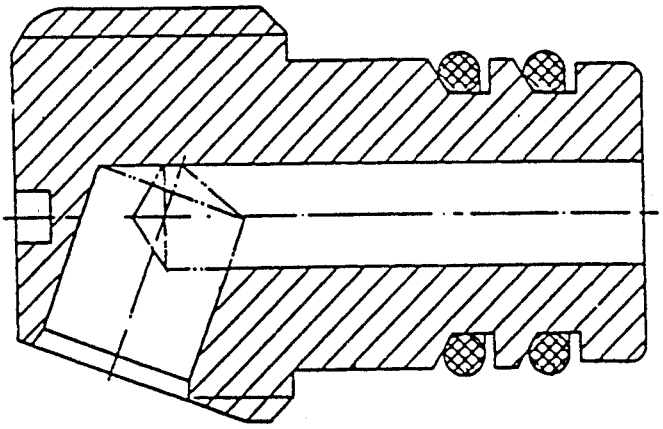
FIG. 3 is a section through the nozzle holder.
Figure 4:
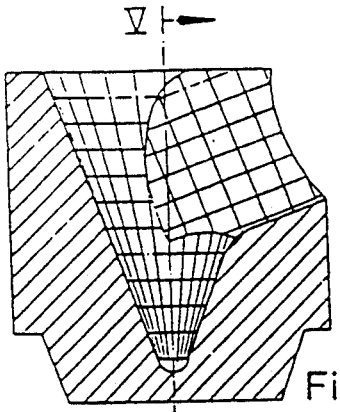
FIG. 4 is a section through the orifice of the nozzle illustrated in FIG. 1.
Figure 5:
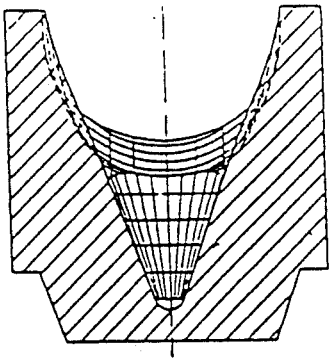
FIG. 5 is a section along the line V—V in FIG. 4.
Figure 6:
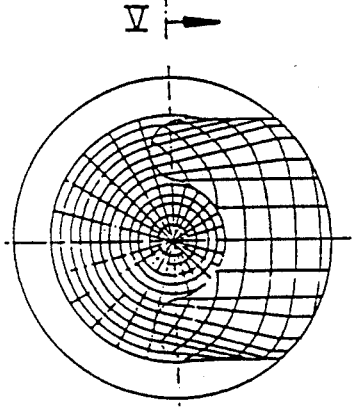
FIG. 6 is a top view of the orifice in FIG. 4.
Figure 7:
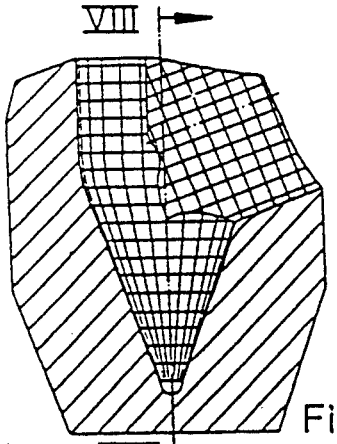
FIG. 7 is a section through the orifice on the outlet nozzle illustrated in FIG. 2.
Figure 8:
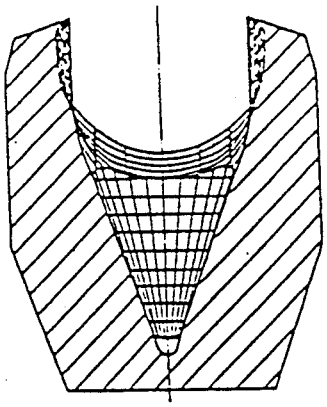
FIG. 8 is a section along the line VIII—VIII in FIG. 7.
Figure 9:
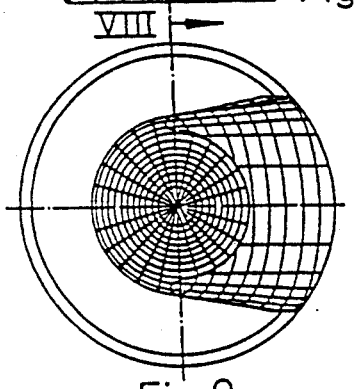
FIG. 9 is a top view of the orifice illustrated in FIG. 7.

Referring now to FIG. 1, an outlet nozzle 1 consists of a nozzle holder 2 and an orifice 3. Nozzle holder 2 accommodates an axial intake channel 4. The axis 5 of symmetry of intake channel 4 is at an angle to the axis 6 of symmetry of orifice 3. Orifice 3 accommodates an axial outlet channel 7 that comprises a cylindrical bore 8 downstream of an entry cone 9. Concentric with the axis of symmetry in the initial section of entry cone 9 is a semicircular recess 10 with the same radius as intake channel 4. The transition from recess 10 to entry cone 9 is curved. The smooth and straight channel extending into entry cone 9 prevents the previously common phenomena of cavitation and erosion at the point of contact between the outside diameter of orifice 3 and the adjacent contour of intake channel 4.

Upstream of the entry cone 9 in the embodiment illustrated in FIG. is another cylindrical entry section 11. This characteristic further optimizes the flow.

FIG. illustrates the nozzle holder before the orifice is inserted. It is unnecessary to machine the nozzle holder once the orifice has been inserted.

The precise shape of the recess 10 in various embodiments of the orifice will be evident from FIGS. 4 through 9.

It is practical to fabricate entry cone 9 and recess 10 before securing the orifice in the nozzle holder because subsequent machining is difficult due to hardness of the orifice.

It is of most advantage to introduce entry cone 9 and recess 10 while the blank is being compacted.

What is claimed is:

1. An outlet nozzle for centrifuge drums, comprising: a nozzle holder with an axial intake channel having an axis of symmetry and means forming an orifice composed of a harder material than the nozzle holder and received in the intake channel, the means forming the orifice comprising an entry cone and an axial outlet channel having an axis of symmetry and comprising a cylindrical bore downstream of the entry cone, wherein the orifice is positioned in the intake channel such that the axis of symmetry of the intake channel is at an angle to the axis of symmetry of the outlet channel to divert the flow of the fluid through the nozzle, and wherein the entry cone has an initial section immediately adjacent to the intake channel and having a semicircular recess concentric with the axis of symmetry of the outlet channel and having the same radius as the intake channel.

2. The outlet nozzle as in claim 1, wherein the transition from the recess to the entry cone is curved.

3. The outlet nozzle as in claim 2, further comprising a cylindrical entry section upstream of the entry cone.

4. The outlet nozzle as in claim 3, wherein the entry cone and the recess are fabricated before the orifice is secured in the intake channel.

5. The outlet nozzle as in claim 4, wherein the orifice is a compacted blank and the entry cone and the recess are introduced while the blank is being compacted.

* * * * *